United States Patent [19]

Perrissoud

[11] Patent Number: 4,910,892

[45] Date of Patent: Mar. 27, 1990

[54] SKI BOOT

[75] Inventor: Claude Perrissoud, Saint-Jorioz, France

[73] Assignee: Salomon S.A., Annecy, France

[21] Appl. No.: 215,462

[22] Filed: Jul. 5, 1988

[30] Foreign Application Priority Data

Jul. 3, 1987 [FR] France ..... 87 09972

[51] Int. Cl.[4] ..... A43B 5/04

[52] U.S. Cl. ..... 36/120; 36/121

[58] Field of Search ..... 36/117–121, 36/105

[56] References Cited

U.S. PATENT DOCUMENTS

| | | | |
|---|---|---|---|
| 3,696,534 | 10/1972 | Hornung | 36/121 |
| 4,085,528 | 4/1978 | Delery | 36/121 |
| 4,470,206 | 9/1984 | Annovi | 36/121 |
| 4,519,149 | 5/1985 | Pozzobon | 36/121 |
| 4,669,203 | 6/1987 | Sartor | 36/120 |
| 4,677,771 | 7/1987 | Arieh et al. | 36/120 |
| 4,709,491 | 12/1987 | Morell et al. | 36/121 |
| 4,712,315 | 12/1987 | Morell et al. | 36/117 |
| 4,761,899 | 8/1988 | Marxer | 36/121 |

FOREIGN PATENT DOCUMENTS

| | | |
|---|---|---|
| 2569088 | 1/1987 | France . |
| 2583271 | 4/1988 | France . |

*Primary Examiner*—James Kee Chi

*Attorney, Agent, or Firm*—Pollock, Vande Sande & Priddy

[57] ABSTRACT

The boot is comprised of a shaft (12, 13) jointed along a transverse axis (11) to a shell-base (10), and of a mechanism for controlling the stiffness of the pivoting movements of the shaft (12, 13) in relation to the shell-base (10). This mechanism incorporates, in the form of a double girder, two flexion arms (1,2) joined at one end, respectively, and attached to the shaft (12, 13) or to the shell-base (10) by means of an anchoring piece (3). The other end of each strip cooperates with an operating device (5) carried on the shell-base (10) or on the shaft (12, 13), respectively. The device (5) elastically produces variations in the degree of separation of the strips (1,2) in response to the force exerted by pivoting movements of the shaft (12, 13) in either direction.

21 Claims, 5 Drawing Sheets

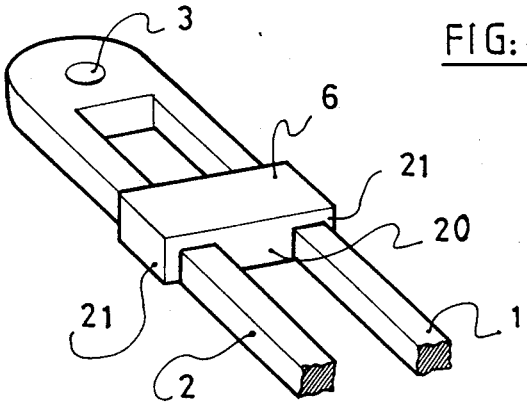
FIG: 4
FIG: 6
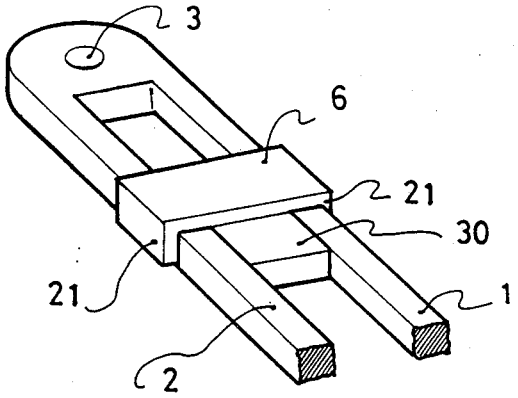
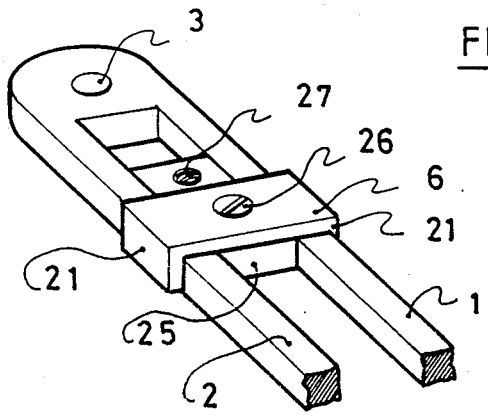
FIG: 5

SKI BOOT

FIELD OF THE INVENTION

The present invention relates to boots for downhill skiing, of the type having a rigid shell-base upon which is fitted a shaft that surrounds the lower part of the leg.

BACKGROUND OF THE INVENTION

In boots of this type, which are generally made of a molded plastic material, the shaft may be comprised of several parts: a collar and a rear flap may be jointed o the shell-base along a transverse axis. If required for a particular shoe, the joint axis may not be given physical form, but the shaft must be able to bend, at least to some degree, in relation to the shell-base, according to the conditions in which the boot is used; this arrangement is the equivalent of a joint.

The general direction of the shaft, which is tightly fastened to the shell-base, is called "the shaft axis" for the sake of simplicity, and inclines anteriorly in relation to the vertical at a particular angle, called the "angle of projection." This angle of projection is liable to vary around a median value, according to the circumstances existing at the time of use, as a result of the joining of the shaft to the shell-base. As a general rule, the taller the skier and the more the skier skis in an extremely flexed position, the more he will desire a high median (static) angle of projection; this angle may be on the order of 13° to 20°, and may occasionally even reach 25°, while, for the tourist skier, an angle of 8° to 15° is generally considered optimal. Furthermore, the skier will, according to the type of skiing being practiced and to the snow conditions, want more or less flexibility in the joint attaching the shaft to the shell-base, i.e., greater or lesser ease of achieving variation of the angle of projection as a result of the force exerted. Thus, rather pronounced stiffness is desired for competition, on packed snow or ice, while more flexibility is desired on powdery snow in order to gauge better the points of support, and during descent in order to use muscular effort economically and to seek a flat ski position.

What these considerations mean is that the ever-increasing number of skiers feel the need for boots that not only have a median angle of projection corresponding to their personal criteria, but in which the stiffness of the joint attaching the shaft to the shell-base is in direct relation to the force exerted on the shaft, thus enhancing the users' comfort and safety.

Attempts have, therefore, been made to fulfill these requirements by means of devices which control this power of flexion. Many ideas have been advanced, e.g., boots described in French Patent Application No. FR 2 583 271 or in French Patent No. FR 2 569 088, which represent distinct progress over the previously-known technology. In these documents, use is made of flexion devices in the form of double elastic girders, which are attached to the shell-base, and of which at least a portion cooperates, by means of movable contact, with a surface or guide-ramp which acts as a cam, and which is carried on the shaft of the boot. In the first case, the double flexion girder is positioned in a generally transverse direction in relation to the boot. In the second, it is positioned in a generally longitudinal direction.

These two mechanisms are perfectly satisfactory in controlling stiffness of the shaft as it pivots in an anterior direction in relation to the shell-base, but they make no provision for the stiffness of the joint in the reverse direction of pivoting, that is, toward the rear when the skier requires posterior support. In the absence of any control, this rearward flexion may seriously compromise the safety and comfort of the skier, especially in very difficult conditions, as, for example, in competition. It is therefore essential to have mechanisms available which permit control of the pivoting of the shaft, both anteriorly and posteriorly in relation to the shell-base.

The present invention concerns a mechanism enabling bi-directional control.

BRIEF DESCRIPTION OF THE DRAWINGS

In order that the invention may be more clearly understood, reference will now be made to the accompanying drawings, in which several embodiments of the invention are shown for purposes of illustration, and in which:

FIGS. 4, 5, and 6 are perspective views of various embodiments of one means of adjusting the device according to the invention;

DESCRIPTION OF THE PREFERRED EMBODIMENTS

Figure 1:
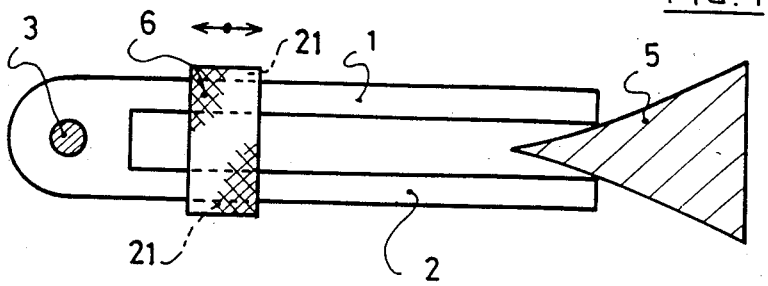
FIG. 1 is a schematic plan view of a prior art device for controlling stiffness exerted in an anterior direction.

FIG. 1 illustrates the state of the art as represented, for example, by French Patent No. 2 569 088, already mentioned. A double girder, for example in the shape of a tuning fork, has two elastic arms 1,2 designed to operate by flexion. These are joined together at one end, where they are attached using an anchoring piece 3 to a point on the shell-base or on the shaft of the boot equipped with this device. At the other end, the arms 1,2 cooperate with a device 5 which is joined respectively to the shaft or to the shell-base of the boot. This device, which is in the form of a guide ramp or double cam track, elastically causes the two arms 1 and 2 to move apart by flexion when the shaft pivots forward in relation to the shell-base. A slider 6, which is movable along arms 1,2, allows the stiffness of the device to be used to advantage. As can be seen, this device is operational in only one direction, the one in which anchoring piece 3 moves toward device 5, i.e., in the direction f what conventionally is called forward flexion. In the opposite direction, i.e., rear flexion, the device is completely ineffectual.

Figure 2:
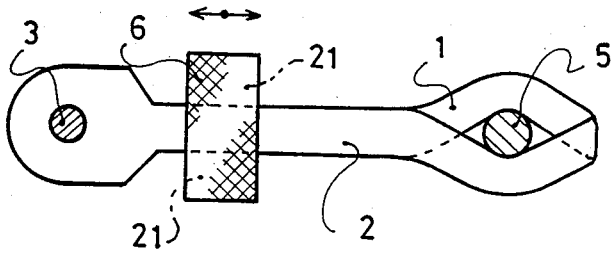
FIG. 2 is a schematic plan view illustrating the principle of the bi-directional operation of a device according to the invention.

FIG. 2 illustrates the principle of operation of an embodiment of the invention derived from the mechanism just described, but which allows a bi-directional effect to be achieved. As previously described, there is a double girder anchored by one end 3 to the shell-base or to the shaft of the boot. In this embodiment, arms 1 and 2, which are joined at the end where anchoring piece 3 is located, and which exhibit only a slight play between them in order to minimize the relative friction, are preferably superposed. They move apart in a single plane near the free end, then are rejoined, still in the same plane, thus forming a clamp which grips laterally, but with longitudinal play, a device 5 fastened to the shaft or shell-base, respectively. This device 5 is preferably in the form of a circular pin; the inside surfaces of the arms of the clamp have a curvature less than that of the pin, so as to constitute two advancing guide-ramps on each side of device 5 in a longitudinal direction. These two guide ramps may also be flat, thus forming a dihedral angle whose two planes would, in the median position, rest on device 5; the curved shape is, however, preferable.

When a pivoting motion occurs toward the front of the shaft in relation to the shell, anchoring piece 3 and device 5 tend to move toward each other, thus separating by elastic flexion arms 1 and 2 of the clamp and controlling the range and the resistance of this pivoting. In the event of rearward pivoting, the anchoring piece 3 and device 5 tend to move apart, which also causes the flexible separation of arms 1 and 2 of the clamp and controls the rocking motion.

As in FIG. 1, a slider 6 gripping arms 1 and 2 provides for adjustment of the point where arms 1 and 2 are effectively held in position, and thus of the stiffness of the boot.

Figure 3A:
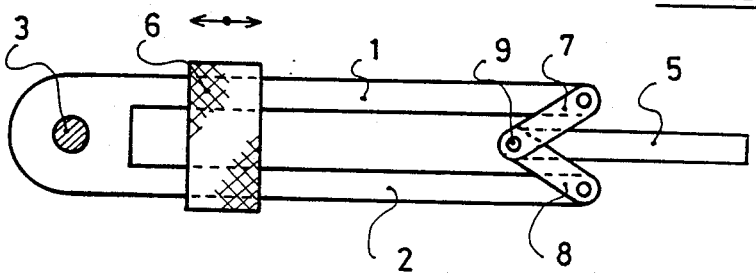
FIGS. 3A and 3B show two variations of another embodiment according to the invention.
Figure 3B:
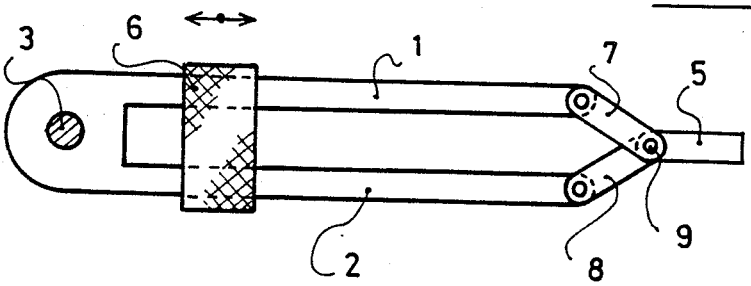

FIGS. 3A and 3B illustrate the principle underlying two variations of another embodiment of the invention. The mechanism is identical to that of the technology described above, except as regards the ends of arms 1 and 2 opposite to anchoring piece 3. A connecting rod 7,8 is jointed to this end of each of the arms 1,2. The connecting rods 7,8 are also jointed to each other at their other ends at a point 9 located in the plane of symmetry of the device. Joint 9 is, further, attached to a device 5, for example one in the shape of a shaft, anchored to that part of the boot, either shaft or shell-base, which does not carry anchoring piece 3.

The length of connecting rods 7,8 may be chosen so that, in the median position, joint 9 is aligned with the joints connecting the connecting rods to the arms 1 and 2. A forward pivoting motion will cause the joint to move toward anchoring piece 3, and a rearward pivoting motion will cause it to move away from that piece. In both cases, the pivoting motion will cause the ends of arms 1 and 2 to be brought together by elastic flexion.

If the length of connecting rods 7 and 8 is greater, the situation portrayed in either FIG. 3A or FIG. 3B will occur. In the case of FIG. 3A, a forward pivoting motion will cause the the ends of arms 1 add 2 to move together, while a rearward pivoting motion ill produce the separation of these arms. The effect will obviously be the reverse in the arrangement shown in FIG. 3B.

As in previous examples, a slider 6 allows the adjustment of the functional length of arms 1 and 2, and thus of the stiffness of the device.

However, since arms 1 and 2 work by elastic flexion in order to bring together or separate their ends, slider 6 may advantageously contain an internal support-stop 20, as shown in FIG. 4, in addition to the lateral flanges which constitute the external support-stop, as in the preceding figures; thus, slider 6 allows the adjustment of the functional length of arms 1 and 2 in both of the directions in which these arms may be flexed. Of course, a separate adjustment of the functional length of the arms according to the direction of flexion, may also be provided. For this purpose, as shown in FIG. 5, slider 6 cooperates with an internal support stop 25 which is movable in relation to the slider by means of a screw 26 which may be mounted in either ofthe positioning holes 27 in the slider, and which may be engaged, by its threaded end, in one of the threaded holes in support stop 25. Again, the internal support stop 30, shown in FIG. 6, may be designed to extend, in relative fashion, beyond the lateral flanges 21 of the slider to which it is attached. Similarly, although not shown, internal support stop 20, 25, and 30, and/or slider 6, may be made adjustable and positioned on the portion of the boot which is equipped with the mechanism, one independently of the other. A slider 6 equipped only with an internal supportstop 20, 25, and 30, and without an external support-stop 21, may be provided.

To facilitate understanding of the embodiments shown in the succeeding figures, slider 6 will be mentioned, leaving aside the construction details it may exhibit and that have just been described with reference to FIGS. 4, 5, and 6.

Figure 7:
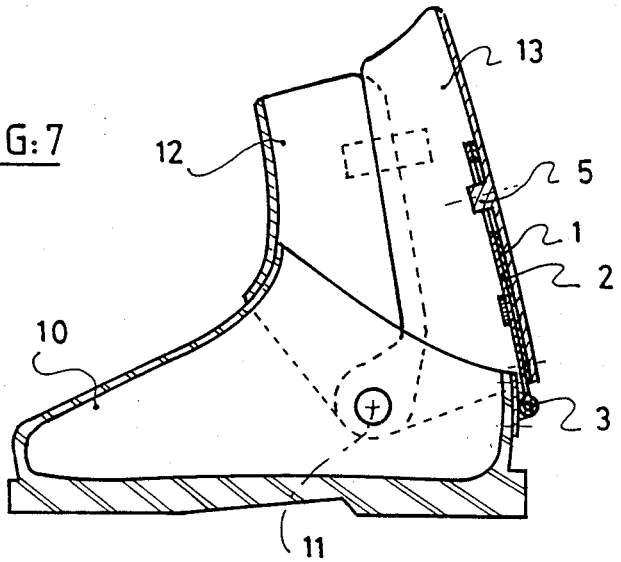
FIG. 7 is a section elevation view of a rear-entry type of boot showing one example of the implementation of the invention.

FIG. 7 shows, schematically, a boot equipped with a mechanism similar to those that have been described above. The drawing illustrates a shell-base 10, on which is attached, along a transverse axis 11, a shaft comprised of a collar 12 and a rear flap 13. A control device, of one of the types previously described, is anchored on the rear of the shell-base 10, at point 3. The double girder 1,2 rises from the heel, behind the Achilles tendon, and extends to device 5 connected to rear flap 13.

Figure 8:
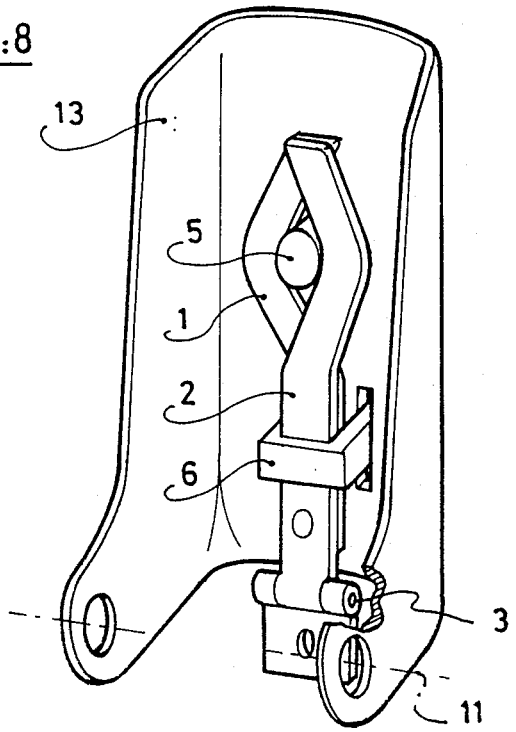
FIG. 8 is a perspective view of the rear flap of a ski boot, equipped with the device according to the invention in FIG. 2.

FIG. 8 shows the rear flap thus equipped, preferably on the inside, with the mechanism shown in FIG. 2, but having an arrangement in which the pins of anchoring piece 3 on the shell-base (not shown) and device 5 are mutually perpendicular.

Figure 9:
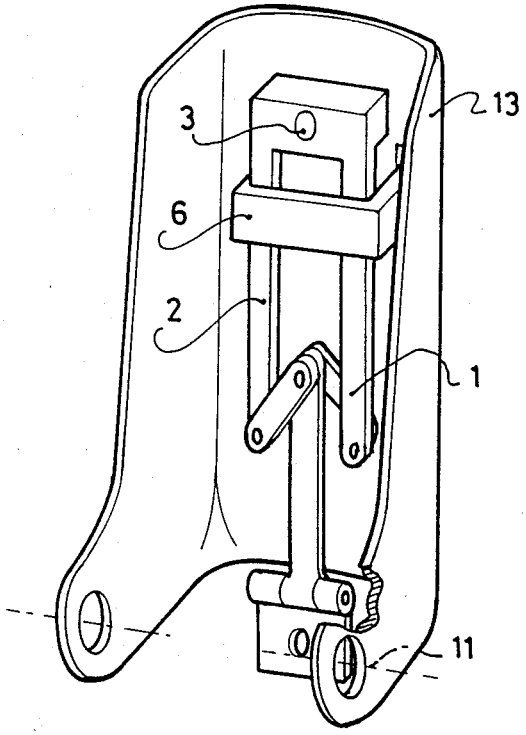
FIGS. 9 and 10 are similar to FIG. 8, with the embodiment and positions shown in FIGS. 3A and 3B.
Figure 10:
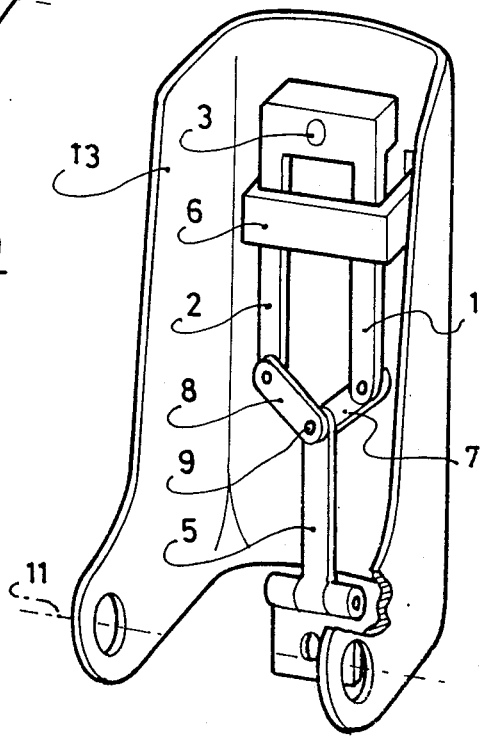

FIGS. 9 and 10 are similar, but show mechanisms from FIGS. 3A and 3B, respectively. In this case, anchoring piece 3 is installed in rear flap 13 and device 5 forms one piece with the shell-base (not shown).

Figure 11:
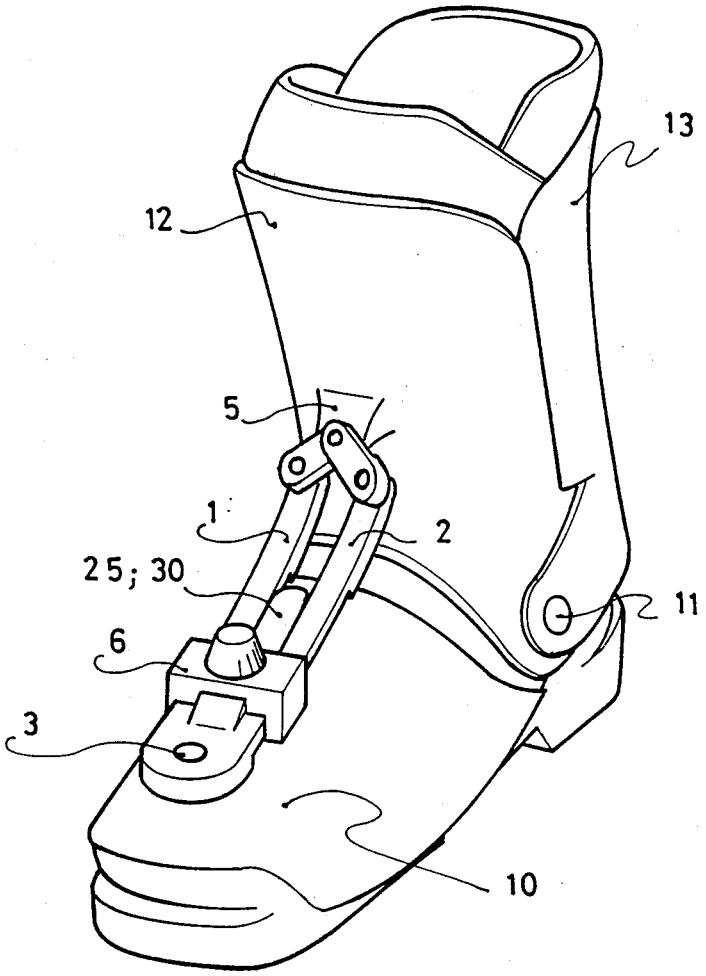
FIG. 11 shows another embodiment of the deice according to FIGS. 3A and 3B.

FIG. 11 shows another boot according to the invention, in which a device for controlling stiffness as determined by the pivoting motion according to FIG. 3B is installed on the front side. Anchoring piece 3 is located on the front of shell-base 10, and device 5 is located on the collar 12 above the instep.

It is evident from the preceding explanation that, based on the principles applied in FIGS. 2, 3A and 3B, other variations may be contemplated that do not require detailed descriptions. In particular, a mechanism for controlling the stiffness of the pivoting movements of the shaft in relation to the collar could just as easily be installed on one or both sides of the boot.

Furthermore, arms 1 and 2 may be attached by some fastening method in the area of anchoring piece 3, or they may be provided as a single piece constituting the double girder.

Arms 1,2 may have a variable cross-section, for the purpose of obtaining stiffness control which increases with the magnitude of the flexion.

What is claimed is:

1. A boot, especially a downhill ski boot, comprising a shaft at least partially articulated along a transverse axis to a shell-base (10) for pivoting movement in relation to said shell base, and a mechanism for controlling the stiffness of pivoting movements of said shaft (12, 13) in relation to said shell-base (10), said mechanism comprising two flexion arms (1, 2) joined at one end (3), respectively between said flexion arms, and by an anchoring piece mounted on one of said shaft (12, 13) and said shell-base (10), wherein said arms cooperate, at their other end, with an operating device (5) carried by one of said shell-base (10) and said shaft (12, 13), which produces elastically variations in the distance separating said arms transversely of said boot, in response to a force exerted by pivoting movement of said shaft (12, 13) in relation to said shell-base (10), in both a forward and backward direction.

2. Boot according to claim 1, wherein said arms (1,2) form a double girder.

3. Boot according to claim 2, wherein said arms (1,2) are joined together near said anchoring piece (3) by fastening means.

4. Boot according to claim 2, wherein said arms (1,2) are of one piece constituting said double girder.

5. Boot according to any one of the claims 1 to 4, wherein said arms (1,2) have, at the ends opposite to said anchoring piece (3), a shape constituting a clamp which grips elastically said operating device (5) in a transverse direction, but with longitudinal play.

6. Boot according to claim 5, wherein said device (5) is a circular pin.

7. Boot according to any one of claims 1 to 4, wherein a connecting rod (7,8) is connected to an end of each arm (1,2), said connecting rods (7,8) being themselves jointed one to the other and to a device (5) fastened to said shell-base((10) or to said shaft (12, 13), at a joint (9) located between ends of said rods (1,2).

8. Boot according to claim 7, wherein said joint (9) connecting said connecting rods (7,8) and said device (5) is, in its median position, aligned with the joints attaching said connecting rod (7,8) to said arms (1,2).

9. Boot according to claim 7, wherein said joint (9) connecting the connecting rods (7,8) and said device (5) is located on a side of said anchoring piece (3) in relation to said joints attaching said connecting rods (7,8) to said arms (1,2).

10. Boot according to claim 7, wherein said joint (9) connecting said connecting rods (7,8) and said device (5) is located on a side opposite to said anchoring piece (3) in relation to said joints attaching said connecting rods (7,8) to said arms (1,2).

11. Boot according to any one of claims 1 to 4, wherein a slider (6) gripping said arms (1,2) is movable along said arms (1,2) in order to vary the stiffness of the mechanism.

12. Boot according to claim 11, wherein said slider (6) grips said arms (1,2) by lateral flanges (21) which constitute an external support stop.

13. Boot according to claim 11, wherein said slider (6) incorporates an internal support stop (20, 25, 30).

14. Boot according to claim 13, wherein said internal support stop (25) may be adjusted in position in relation to said lateral flanges (21) of said slider (6).

15. Boot according to claim 11, wherein said slider (6) may be adjusted into position on a part of said boot equipped with said mechanism.

16. Boot according to claim 13, wherein said internal support stop (25) may be adjusted into position on a part of said boot equipped with said mechanism.

17. Boot according to any one of claims 1 to 4, wherein said shaft comprises a collar (12) and a rear flap (13), and the mechanism for control of stiffness is positioned between said rear flap (13) and said shell-base (10).

18. Boot according to claim 17, wherein said mechanism for control of stiffness is installed on the inside of said rear flap (13).

19. Boot according to claim 17, wherein said stiffness control mechanism is installed on the outside of said rear flap (13).

20. Boot according to any one of claims 1 to 4, wherein said stiffness control mechanism is installed on the front part of said boot between said shell-base (10) and said shaft (12, 13).

21. Boot according to any one of claims 1 to 4, wherein a stiffness control mechanism is installed on at least one side of said boot between said shaft (12, 13) and said shell-base (10).

* * * * *